United States Patent [19]

Dutt et al.

[11] Patent Number: 4,687,116

[45] Date of Patent: Aug. 18, 1987

[54] EASY OPEN CONTAINER END CLOSURE

[75] Inventors: Herbert V. Dutt; Paul A. Santostasi, both of Sarasota, Fla.

[73] Assignee: Sun Coast Plastics, Inc., Sarasota, Fla.

[21] Appl. No.: 905,416

[22] Filed: Sep. 10, 1986

[51] Int. Cl.[4] ..... B65D 17/34

[52] U.S. Cl. ..... 220/270; 220/269

[58] Field of Search ..... 220/269, 270, 271, 272, 220/273

[56] References Cited

U.S. PATENT DOCUMENTS

| | | | |
|---|---|---|---|
| 3,172,558 | 3/1965 | Wilkinson . | |
| 3,494,500 | 2/1970 | Foster . | |
| 3,858,753 | 1/1975 | Brautigam . | |
| 4,014,455 | 3/1977 | LaCroce . | |
| 4,253,582 | 3/1981 | Shields | 220/270 |
| 4,324,342 | 4/1982 | Yamaguchi et al. | 220/270 |
| 4,446,985 | 5/1984 | Dickson | 220/269 |
| 4,467,938 | 8/1984 | Allen | 220/270 |
| 4,605,141 | 8/1986 | Won . | |

*Primary Examiner*—George T. Hall

*Attorney, Agent, or Firm*—Jones, Tullar & Cooper

[57] ABSTRACT

An easy open container end closure utilizes a pair of angled force directing score lines to direct an upward closure opening force which is applied to a pull ring or pull tab to an initial break line of finite length. The force directing score lines allow the container lid to pucker and to direct the applied opening force to the initial break line. Once this line has severed, continued lid separation acts in shear at two points of separation. The result is a container end closure which requires substantially less opening force than do prior art devices.

18 Claims, 7 Drawing Figures

EASY OPEN CONTAINER END CLOSURE

FIELD OF THE INVENTION

The present invention is directed generally to an easy open container end closure. More particularly, the present invention is directed to an easy open container end closure or lid which includes force directing score lines. Most specifically, the present invention is directed an easy open container end closure having a pull ring assembly flanked by force directing score lines. The force directing score lines direct an opening force exerted on the pull ring assembly of the container end or closure toward an initial break line. Opening forces are thereby properly applied at the desired point of the closure to insure that the closure tears or shears at the intended area. The pull ring may be held down against the surface of the closure lid prior to use by sonic welds or the like. In addition, a pull ring hold down tab may be incorporated on the upper surface of the lid to hold the pull ring out of the way in situations where the tear away portion of the closure is not completely separated from the lid assembly.

DESCRIPTION OF THE PRIOR ART

Various easy open container ends or lids are known generally in the prior art. These are all intended to allow the consumer to open the container and pour or dispense its contents without the need to utilize a can opener, bottle opener or other opening adjunct. Such easy open containers can be considered as falling generally into two groups, by size of opening. Either the entire end of the lid tears away, as is often the case with containers of peanuts and the like, or a dispensing opening is formed, as may be the situation with beverages or other flowable materials. In either situation a pull ring or tab is typically grasped by the consumer and is manipulated to tear away or sever the lip top along a preformed line or lines of weakening.

Easy open containers, despite their design, are often actually difficult to open. One reason is that the line of weakening about which the tear away portion is to separate from the remainder of the closure must have sufficient strength to withstand anticipated rough handling such as droppage. Once the initial break has been made in the line of weakening, the tear away portion will usually function as intended. However, starting the break or tear sometimes requires more hand strength than many consumers can provide. This may be the case in either container lid configuration, i.e., total tear away top or dispensing opening.

A sleeved container and closure assembly which utilizes a plastic easy open tear away closure lid is shown in co-pending application Ser. No. 832,804, filed Feb. 25, 1986 and assigned to a common assignee. The disclosure of that application is incorporated herein by references and sets forth a container and closure assembly in which the closure is attached to the sleeved container solely by frictional cooperation and without the use of adhesives. In container closures of this type, it is essential that the easy open end closure or lid operate properly and without the exertion of too great a force. As will be appreciated, if the tear away lid portion does not separate along the score line under the influence of a small force, it is possible that the entire container end may separate from the ocntainer, particularly where a friction fit has been relied on. Such an accidental closure assembly removal is likely to create a problem of spillage and will certainly diminish consumer acceptance of the package.

When the tear away portion of the container end or lid encompasses substantially the entire end of the container, the pull tab or ring is removed with the severed lid. In the situation where the pull tab or ring is used to open a dispensing slot or drinking opening so that the pull ring remains on the container end, the ring often gets in the way and may interfere with the free flow of substance being dispensed or consumed. With prior art metal pull rings this problem can be minimized by bending the metal pull ring out of the way. When the container end is plastic, the pull ring on the closure is not easily kept out of the way and thus may interfere.

Pull rings or tabs present a possible problem of being inadvertently snagged or caught and pulled. This may result in unintended container openings and spillage of container contents. Unless the pull ring is held flat against the surface of the container end lid, it may be pulled at other than the desired time. This problem is particularly apparent when the container end is made of plastic. In these situations, the natural flexibility of the material allows the pull ring to stand away from the container lid's tear away surface.

While plastic tear away container ends or lids are generally known in the art, the prior devices have sometimes not opened as easily or predictably as might be desired and have sometimes been troubled with pull ring snagging. Accordingly, a need exists for an easy open tear away container end or closure assembly which is sufficiently strong to withstand the normal impacts incident to container filling, shipping, and handling yet which can be easily opened by actuation of a pull tab or ring. Further, this container end should have a pull tab which can be held out of the way before and after use. The easy open container end closure in accordance with the present invention provides such an assembly.

SUMMARY OF THE INVENTION

It is an object of the present invention to provide an easy open plastic container end closure.

Another aspect of the present invention is to provide a tear away plastic lid having a pull ring.

A further object of the present invention is to provide a container closure having force directing means.

Yet another object of the present invention is to provide an easy open tear away plastic container end having force directing score lines.

Still a further object of the present invention is to provide an easy open container closure including pull ring hold downs.

Yet still another object of the present invention is to provide an easy open plastic container end lid having a pull ring holding tab.

Even still yet a further object of the present invention is to provide an easy open tear away plastic container end closure having force directing score lines adjacent a pull ring.

As will be discussed in greater detail in the description of the preferred embodiment as set forth subsequently, the easy open container end closure in accordance with the present invention includes a plastic lid assembly having a tear away portion defined by lines of weakening, and a pull ring applying a separating force to the tear away portion. Force directing means in the form of force directing score lines are placed adjacent the anchor point of the pull ring and direct the opening force exerted on the pull ring to a desired point of application, typically an initial break line segment of the line of weakening which defines the tear away portion of the closure. These force directing score lines cause the lid to raise or pucker adjacent the pull ring anchor point but the score lines themselves do not initially tear. Instead, the break line portion of the line of weakening adjacent the point of convergence of the force directing score lines initially separates. Once the initial separation has been made, the tear away portion of the container end may be easily separated from the lid assembly in accordance with the container end configuration.

The easy open container end closure in accordance with the present invention has sufficient strength to withstand the usual shocks that occur during package handling, shipping and distribution. The lines of weakening need not be so thin that they are subject to unintentional rupture if, for example, the container is dropped. Since the easy open container end closure assembly in accordance with the present invention utilizes force directing score lines to direct the opening force applied to the pull tab or ring to the proper section of the line of weakening, the line need not be made so thin as to create possible problems of unwanted separation. Also, since the force directing score lines direct the opening force to the proper area, the actual amount of froce that must be applied can be lessened when compared to prior art devices. The force directing score lines which are located adjacent the anchor part of the pull tab or ring assembly cause the tear away portion of the lid between the force directing scores to raise of pucker as the pull ring is pulled up and back. It is this puckering that directs the opening force to the initial break line portion of the line of weakening to start separation of the tear away portion of the container end from the rest of the closure assembly.

When the tear away container end includes essentially all of the lid assembly excepts for the container engaging clamping ring; i.e., when the line of weakening extends around the entire circumference of the container end, the pull ring separates with, and is discarded with the tear away end. In other instances, when the lid is provided with a dispensing opening generally in the nature of a small opening, the pull ring typically stays on the opened portion of the end and is not completely separated from the container closure. In both situations, the pull ring is initially held against the surface of the container end by, for example, a pair of energy directors for a pair of sonic weldments. The pull ring thus does not freely extend away from the container's end surface and will not snag. After the pull ring has been pulled up to its use position, and has been utilized to open a dispensing aperture in a container such as, for example a single strength juice beverage container, the torn open portion and the pull ring are secured over a hold down tab molded on the top of the lid. This hold down tab thus keeps the opened flap out of the way so that it does not interfere with container dispensing or consumption.

The easy open container end closure in accordance with the present invention significantly reduces the amount of force required to open the container. The obvious advantage of this force reduction is to make the container easier to use. The force directing score lines direct the initial tearing force to a small initial break line instead of being spread out as in prior art devices. A less obvious advantage of the reduced opening force required by the easy open container end closure of the present invention is a substantial reduction in the likelihood of spillage of the container's contents. The force directing score lines allow the container to be opened by application of a steady even pull. This is in marked cotrast to prior tear away lids which separated in an erratic, unpredictable manner. A consumer opening a container provided with a container end utilizing the force directing score lines of the present invention will be much less apt to spill the container's contents.

The easy open container end closure assembly in accordanee with the present invention utilizes force directing score lines to provide a closure which includes an openable portion that requires less force and that is more predictable than prior art devices. The pull ring is held down and out of the way prior to use and is also held back and out of the way after opening when the pull ring assemlby stays with the container. This closure assembly is a significant advance in the art and provides a number of positive features.

BRIEF DESCRIPTION OF THE DRAWINGS

While the novel features of the easy open container end closure in accordance with the present invention are set forth with particularity in the appended claims, a full and complete understanding of the invention may be had by referring to the detailed description of preferred embodiments, as is set forth hereinafter, and as are illustrated in the accompanying drawings in which:

DESCRIPTION OF THE PREFERRED EMBODIMENT

Figure 1:
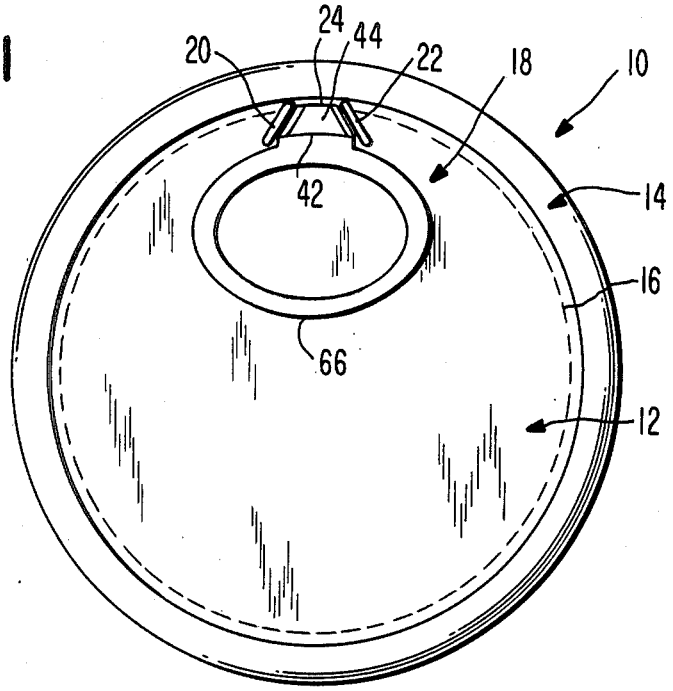
FIG. 1 is a top plan view of a first embodiment of an easy open container end closure in accordance with the present invention.

Turning initally to FIG. 1, there may be seen generally at 10 a first preferred embodiment of an easy open container end closure in accordance with the present invention. In this first preferred embodiment a large tear away lid, generally at 12, is joined to a clamping rim portion, generally at 14, by a circumferential line of weakening 16 which is shown in dashed lines in FIG. 1. A pull ring assembly, generally at 18 is attached to the tear away lid 12. A pair of force directing score lines 20 and 22 flank the pull ring assembly 18 and, as will be discussed shortly in greater detail, direct the pulling force exerted on the pull ring assebmly 18 and concentrate it along an initial break line 24.

It will be understood that the preferred embodiments of the easy open container end closure in accordance with the present invention are intended to be molded from plastic. The invention is not limited to any one specific plastic composition since the various plastics useable as container end closures and lids of this general type are known in the art. The specific overall dimensions of the closure are also not limiting factors of the invention. Further, while the invention will be shown and discussed for use with a generally circular container end, such a shape is to be construed as exemplary and not limiting.

Easy open container end closure assembly 10 in its first preferred embodiment is useable with frozen juice concentrates, and various other commodities. An overall assembly of lid and container is set forth in detail in co-pending application Ser. No. 832,804, filed Feb. 25, 1986 and assigned to a common assignee. As is set forth in detail in that application, and as may be seen in FIGS. 2 and 3 taken in combination with FIG. 1, closure assembly 10 includes a clamping rim generally at 14 which is structured to secure the closure assembly 10 to an open end of a container. Clamping rim 14 is formed having a outer clamping channel sidewall 30 and an inner clamping channel sidewall 32 which are joined by a clamping channel web 34. The three segments of the clamping rim 14 define a generally inverted U-shaped clamping channel 38 which is positioned atop the end of an open mouthed container as more fully described in the above-referenced co-pending application.

Figure 2:
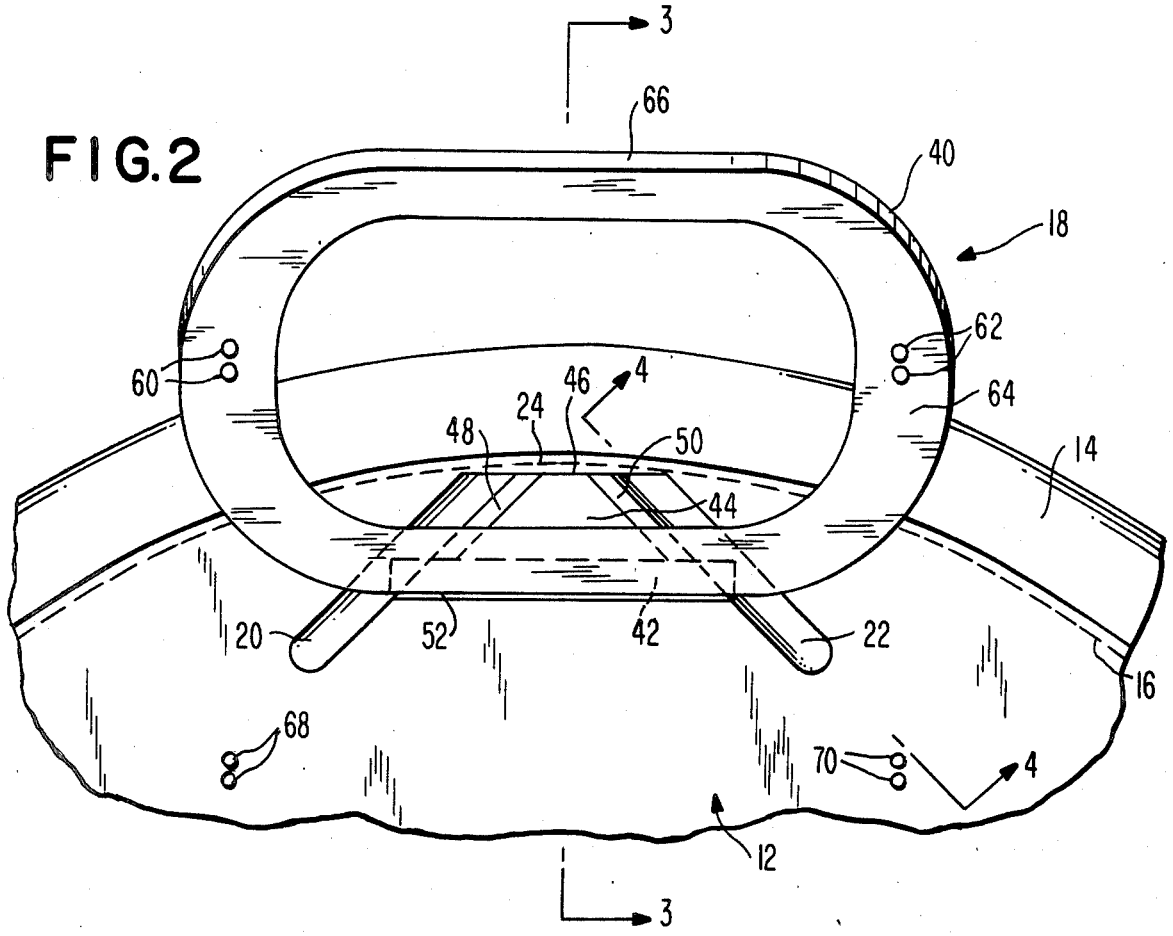
FIG. 2 is a top plan view of a portion of the container end closure of FIG. 1 and showing the pull ring in an elevated, use position.
Figure 3:
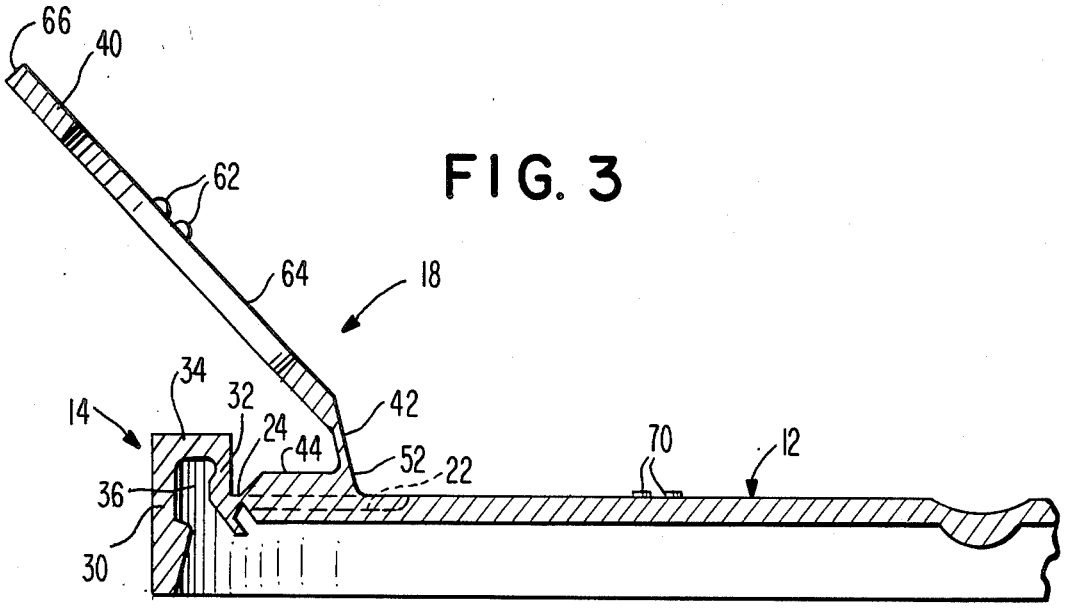
FIG. 3 is a cross sectional view of the easy open container end closure of the present invention and taken along line III—III of FIG. 2.

Pull ring assembly 18, as may be seen most clearly in FIGS. 2 and 3 includes a pull ring 40 that is joined through a hinge strip 42 to a pull ring anchor block 44. This anchor block 44 is molded as a thickened position of lid 12 and may have a generally trapezoidal shape. An apex side 46 of anchor block 44 is located slightly radially inwardly from circumferential line of weakening 16 which is, in turn, formed slightly radially inwardly of inner clamping channel sidewall 32. As was indicated above, that portion of line of weakening 16 which is interposed between pull ring anchor block apex 46 and inner clamping channel sidewall 32 is designated as an initial break line 24. Its function will be discussed in greater detail shortly.

The two force directing score lines 20 and 22 may be seen most clearly in FIG. 2 and are molded parallel to the two inclined angled side walls 48 and 50 of pull ring anchor block 44. In the first preferred embodiment, these force directing score lines are each angled at generally 45° to the vertical, as seen in FIG. 2. This angle is not particularly critical and may be varied to some extent. Each of the force directing score lines 20, 22 extends away from line of weakening 16 beyond a base side 52 of pull ring anchor block 44. As can be seen most clearly in FIG. 3, base wall 52 of anchor block 44 also serves as the point of attachment of pull ring hinge strip 42 to anchor block 44.

Pull ring 40 is molded concurrently with the molding of the rest of the closure end or lid assembly 10 is a generally known manner. During such molding, the pull ring 40 is positioned generally as may be seen in FIGS. 2 and 3; i.e., at an angle with respect to lid portion 12. The pull ring 40 is further molded having energy directors 60 and 62 on an undersurface portion 64. These energy directors 60, 62 are generally cone shaped and are located generally on the long diameter of the generally ovoid pull ring 40. When the pull ring 40 is placed flat against the lid 12, as seen in FIG. 1, sonic energy is applied at the points of contact of the energy directors 60, 62 with the lid 12 and a sonic weldment is effected. This sonic weldment holds the pull ring 40 against the lid 12 until the container is to be opened. At such a time, a slight force applied to the free end 66 of pull ring 40 will break the pull ring 40 free from the weldment to lid 12 leaving only small fracture weld spots 68 and 70, as shown in FIGS. 2 and 3. Thus the pull ring 40 is held in a flat, out of the way orientation until it is to be used. At that time, it is easily and quickly raised to its use position.

Figure 4:
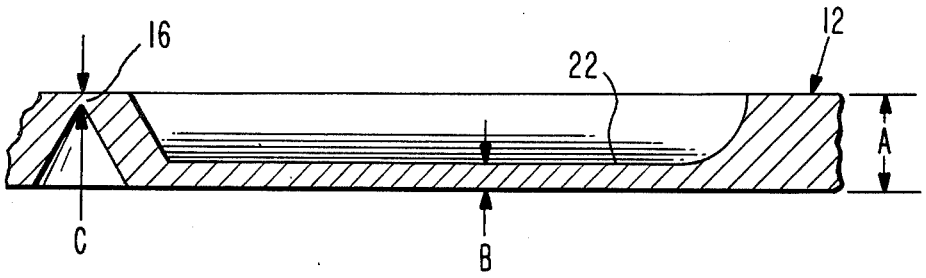
FIG. 4 is a cross sectional view of a portion of the closure, showing the force directing score line, and taken along line IV—IV of FIG. 2.

The relative thicknesses of the lid 12, force directing score lines 20 and 22, and line of weakening 16 including the initial break line 24 are important to the smooth, successful operation of the easy open container end closure assembly of the present invention. The actual thickness will be discussed and may be seen with reference particularly to FIG. 4. It should be kept in mind that the relative thicknesses are important to successful operation than to thickness. The overall thickness of the lid 12, indicated in FIG. 4 as dimension A is generally about 0.035 inch in this preferred embodiment. The thickness of the force directing score lines 20 and 22, shown as dimension B in FIG. 4, is generally about 0.010 inch. The thickness of the initial break line 24 and an adjacent portion of the line of weakening 16, shown as dimension C in FIG. 4, is generally about 0.004 inch to 0.005 inch. This thickness of the line of weakening 16 extneds generally about 60°, centered at the initial break line 24. Throughout the rest of the circumference of line of weakening 16, a thickness of generally about 0.006 inch to 0.007 inch is maintained. It may thus be seen that the lid 12 has a substantially greater thickness than either the force directing score lines 20, 22 or the line of weakening 16, and that the force directing score lines 20, 22 are somewhat thicker that the line of weakening 16. While absolute ratios are apt to vary, the relationship can be stated as being one of a thick lid, a thin line of weakening, and an intermediate thickness force directing score line.

In operation, an upward pulling force is initially applied to free end 66 of pull ring 40 to initially sever the hold down weldments at the energy directors 60 and 62. Once pull ring 40 is free of its weld attachment to lid 12 it can be raised about hinge strip 42 so that a finger tip can be inserted into pull ring 40. Now the application of a pulling force will be channeled by the force directing score lines 20 and 22 to the initial break line 24. The angle of the force directing score lines 20 and 22 actually causes a puckering or outward bowing of the anchor block 44 and tear away lid 12 at the initial break line 24. Initial separation of tear away lid 12 from rim portion 14 is a line break at the initial break line 24. Once this line break has occurred, shearing of the lid is at the points of attachment of the line of weakening 16 to the rim 14. The tear away lid 12 thus separates in a smooth continuous manner. Since the force directing score lines 20 and 22 are thicker that the line of weakening 16, the pull ring anchor block 44 will not tear out of the lid 12. Instead, the lid 12 will separate from the rim 14. This easy, smooth, separation is due to the force directing score lines 20 and 22 which, as was discussed above channel or direct the opening force to the finite length initial break line 24.

In test useage, the force directing score lines 20 and 22 have shown a dramatic reduction in opening pull force required. A container end closure having the same structure as that shown in the first preferred embodiment, but without the force directing score lines 20 and 22 requres a pulling force in the range of 25 to 30 pounds to effect lid separation. In contrast, the easy open, tear off lid in accordance with the preferred embodiment; i.e., one including force directing score lines 20 and 22, required a pulling force of only about 8 to 12 pounds. This marked reduction in opening force caused by the force directing score lines 20 and 22 makes a container provided with container end closure generally as shown in FIG. 10 much easier to open and also much less apt to have its contents spilled as would be the case if the container were subjected to a sudden, upredictable opening which is apt to occur if force directing score lines 20 and 22 are not utilized.

Figure 5:
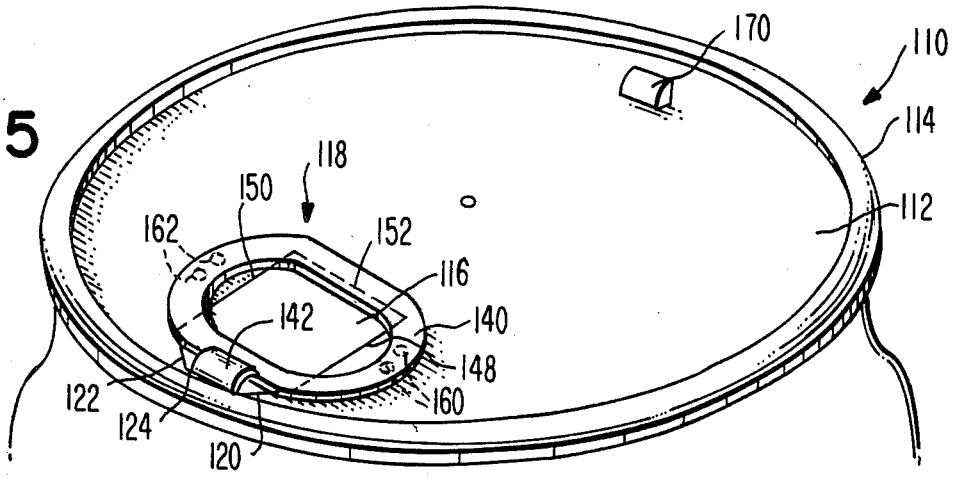
FIG. 5 is a perspective view of the upper portion of a container having a second preferred embodiment of an easy open container end closure in accordance with the present invention.
Figure 6:
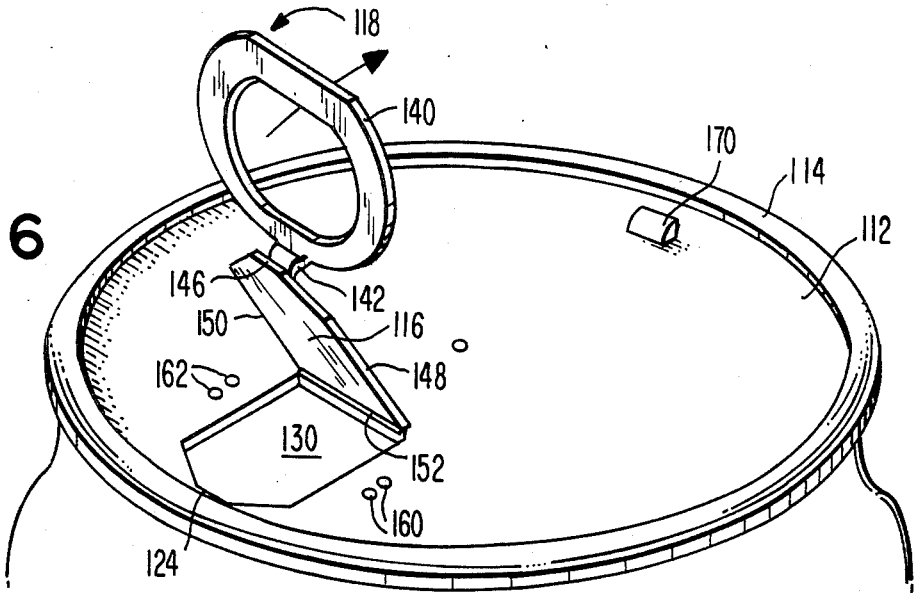
FIG. 6 is a perspective view similar to FIG. 5 and showing the tear away portion of the lid assembly opened.
Figure 7:
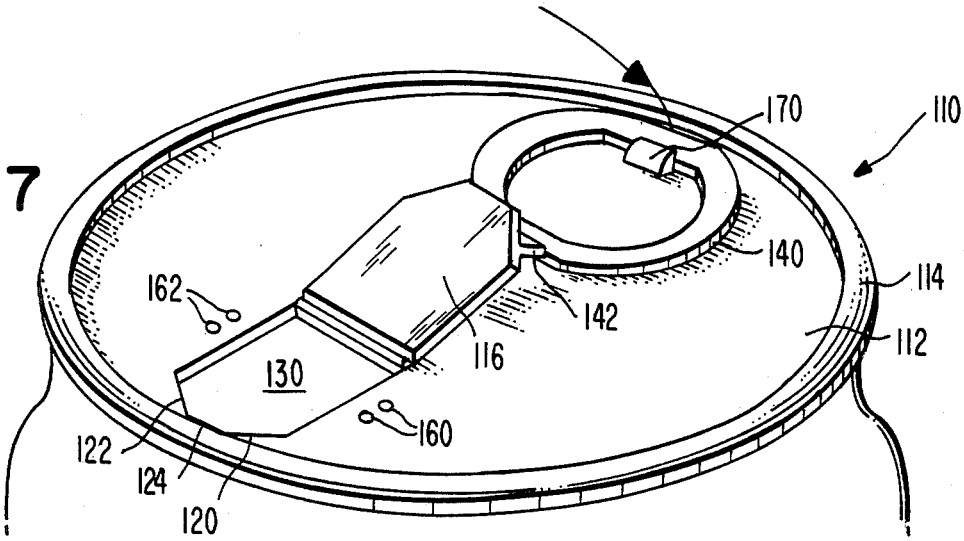
FIG. 7 is a persepctive view of the closure assembly of FIGS. 5 and 6 and showing the pull ring secured to its hold down tab in the fully opened position.

Referring now to FIGS. 5, 6 and 7, there may be seen generally at 110 a second preferred embodiment of an easy open container in accordance with the present invention. Second preferred embodiment 110 is similar to first preferred embodiment 10 in overall concept but differs in that lid 112 of container end closure 110 is not severable from clamping rim portion 114 but instead includes an opening forming flap 116. Pull ring assembly 118 is attached to flap 116 by a hinge strip 142 generally in the same manner as was discussed with easy open container end closure 10. An initial break line 124 is formed at the apex 146 of flap 116. Force directing score lines 120 and 122 start at the ends of the break line 124 and extend rearwardly and outwardly to points of intersection with side score lines 148 and 150 of opening flap 116. A flap hinge line 152 allows flap 116 to bend upwardly upon application of an opening force to pull ring 140.

In a manner similar to that discussed with reference to the first preferred embodiment, the various thicknesses of the score lines and their relations to each other are important to the proper operation of the easy open container end closure. Initial break line 124 has a thickness in the preferred embodiment, of generally about 0.004 to 0.005 inch. The two angled force directing score lines 120 and 122 have thicknesses of generally about 0.005 to 0.006 inch. The two side score lines 148 and 150 have thicknesses of generally about 0.006 to 0.007 inches. Again, as with the first preferred embodiment, it is the progression or relation between thicknesses, in conjuntion with the angled force directing score lines that makes the easy open container end closure operate successfully.

An upward pull force on the pull ring 140 initially separates the pull ring from its sonic weldments to lid 112 at the energy directors 160, 162. The pull ring 140 can than be raised and an upward force applied to it. The two force directing score lines 120 and 122 will direct and concentrate this force so that it is applied across the initial break line 124. The lid will tend to pucker and breaks across the break line 124. Once the initial break line has separated, the flap 116 will continue to separate from the lid 112 along the angles force directing score lines 120 and 122, and through side score lines 148 and 150. The flap 116 may then be raised to a dispensing position such as is shown in FIG. 6. A lid assembly of this type is ideal for use with single strength juices an other freely flowable or pourable commodities.

As may be seen most clearly in FIG. 7, a pull ring hold down tab 170 may be formed as a protrusion on the upper surface of container end of lid 112. This hold down tab 170 is so located that the pull ring will fit down over it so as to maintain the flap 116 and pull ring 140 flat against the surface lid 112. The flap 116 and pull ring 140 will thus be kept out of the way thereby affording easy dispensing through lid opening 130. Since flap 116 and pull ring 140 can be easily held out of the way be hold down tab 170 there is less likelihood that the consumer will try to separate the flap and pull ring from the lid and possibly dispose of it in an improper manner. This reduces the potential for littering as the assembly stays together in one piece.

In both preferred embodiments of the easy open container end closure in accordance with the present invention, the easy separation of the lid from the end of the opening of the flap is due to the provision of the force directing score lines that direct the upward opening force and concentrate it at the initial break line. Once this line has been broken, the continued separation is a point separation along lines of shear. Thus the force required to open a container provided with the easy open container end closure in accordance with the present invention is significantly less than that required by prior art devices. This reduced force requirement increases consumer satisfaction with the end closure's operation. The flap and pull ring hold down tab makes the second preferred embodiment easier to use and reduces the potential for litter.

While preferred embodiments of an easy open container end closure in accordance with the present invention have been set forth fully and completely hereinabove, it will be apparent to one of skill in the art that changes in, for example, the materials used for the container end, the type of clamping rim structure, the type of container to which the end closure is to be applied, the overall size of the closure, the specific shape of the tear off lid or opening flap and the like could be made without departing from the true spirit and scope of the invention which is to be limited only by the following claims.

What is claimed is:

1. An easy open container end closure assembly comprising:

a container engaging rim;

a container end lid joined to said rim and including a separable portion partially defined by an initial break line;

a pull ring assembly secured to said separable portion of said lid generally adjacent said initial break line; and at least a first force directing score line formed in said lid adjacent said pull ring assembly and having a first end terminating generally adjacent said initial break line.

2. The easy open container end closure assembly of claim 1, wherein said lid is joined to said rim by a line of weakening, said initial break line forming a portion of said line of weakening.

3. The easy open container end closure assembly of claim 2, wherein said initial break line is thinner than said line of weakening and further wherein said line of weakening is thinner than said force directing score line.

4. The easy open container end closure assembly of claim 2, wherein said first force directing score line and a second force directing score line are formed on opposite side of said pull ring assembly and converge toward said initial break line.

5. The easy open container end closure assembly of claim 2, wherein said line of weakening is coextensive with said rim.

6. The easy open container end closure assembly of claim 1, wherein said pull ring assembly is secured to said separable portion of said lid by a pull ring anchor block.

7. The easy open container end closure assembly of claim 6, wherein said anchor block is generally trapezoidal.

8. The easy open container end closure assembly of claim 6, wherein a pull ring is connected to said anchor block by a pull ring hinge strip.

9. The easy open container end closure assembly of claim 1, wherein said pull ring assembly incudes a pull ring separable secured to said lid by sonic weldment through spaced energy directors.

10. The easy open container end closure assembly of claim 1, wherein said separable portion of said lid is partially defined by said first force directing score line and a second spaced force directing score line.

11. The easy open container end closure assembly of claim 10, wherein said initial break line is thinner than said first and second force directing score lines.

12. The easy open container end closure assembly of claim 11, wherein said first and second force directing score lines converge at first ends at said initial break line.

13. The easy open container end closure assembly of claim 12, wherein first and second side score lines formed in said lid join second ends of said first and second ends of said first and second force directing score lines.

14. The easy open container end closure assembly of claim 13, wherein said first and second force directing score lines are thinner than said first and second side score lines.

15. The easy open container end closure assembly of claim 14, wherein said initial break line, said first and second force directing score lines and said first and second side score lines define an openable flap in said lid, said flap being reatined on said lid after opening by a flap hinge.

16. The easy open container end closure assembly of claim 15, wherein said pull ring assembly secured to said flap includes a pull ring.

17. The easy open container end closure assembly of claim 16, wherein a pull ring hold down tab is formed on said lid and is positioned to receive and hold said pull ring when said flap is open.

18. An easy open container end closure assembly comprising:

means to attach said end closure assembly to a container;

a container end lid portion of said end closure assembly, said end lid including a separable portion partially defined by an initial break line having a first thickness;

force applying means carried by said separable portion of said lid generally adjacent said initial break line; and first and second spaced force directing score lines formed on said lid adjacent said force applying means and having converging first ends terminating at said initial break line whereby a container end opening force applied to said force applying means causes said lid to pucker intermediate said force directing score lines thereby directing the opening force to said initial break line.

* * * * *